United States Patent [19]

George

[11] Patent Number: 4,582,625

[45] Date of Patent: Apr. 15, 1986

[54] FABRIC COVERED WASHING AID

[75] Inventor: Burrell F. George, Winnipeg, Canada

[73] Assignee: Chris L. Anderson, Winnipeg, Canada; a part interest

[21] Appl. No.: 558,295

[22] Filed: Dec. 5, 1983

[51] Int. Cl.[4] ..... C11D 17/04

[52] U.S. Cl. ..... 252/93; 252/90; 252/92; 401/201; 206/77.1; 15/222

[58] Field of Search ..... 252/92, 90, 93; 15/104.92, 104.93, 222; 206/77.1; 401/201

[56] References Cited

U.S. PATENT DOCUMENTS

| | | | |
|---|---|---|---|
| 2,958,885 | 11/1960 | Donney | 15/222 |
| 3,076,298 | 2/1963 | Tundermann | 252/92 |
| 3,124,827 | 3/1964 | Hull | 401/201 |
| 3,167,805 | 2/1965 | Zuppinger et al. | 401/201 |
| 3,322,674 | 5/1967 | Friedman | 252/90 |
| 3,931,035 | 1/1976 | Brown | 252/90 |
| 3,949,137 | 4/1976 | Akrongold et al. | 252/92 |
| 4,062,792 | 5/1976 | McNabb | 252/90 |
| 4,190,550 | 2/1980 | Campbell | 252/93 |
| 4,309,014 | 1/1982 | Blaszkowski | 252/92 |

*Primary Examiner*—Paul Lieberman
*Assistant Examiner*—Hoa Van Le
*Attorney, Agent, or Firm*—Stanley G. Ade

[57] ABSTRACT

A washing aid in the form of either a soap tablet or a sponge is covered with a fabric layer formed from spandex yarn. A raschel knit LYCRA ® is stretched over the soap tablet or sponge by firstly manufacturing a tube of the fabric and then injecting the sponge or soap into the tube and sealing the ends of the tube. Heat sealing is used for the transverse seams and heat sealing or sewing can be used for the longitudinal seam of the tube. The apparatus includes an injector, retracting rollers and the heat sealing mechanism.

11 Claims, 5 Drawing Figures

FABRIC COVERED WASHING AID

BACKGROUND OF THE INVENTION

This invention relates to a fabric covered washing aid which may either be in the form of a tablet of soap or a sponge.

Proposals have previously been made to cover household soap in an attempt to improve its handling and increase its longevity, for example, U.S. Pat. No. 4,062,792 (McNabb). However, this proposal is mainly concerned with a central mounting flange for the soap which allows it to be hung over a hook, and in relation to the coating aspect, refers only to the use of a sponge material.

This arrangement has apparently achieved little success since it has not been seen in the marketplace.

SUMMARY OF THE INVENTION

It is one object of the present invention, therefore, to provide an improved covered soap which allows the covering to be applied inexpensively and simply.

It is a further object of the invention to provide a covered soap which has improved handling characteristics in that it can provide an abrasive action and in addition it does not retain moisture thus preventing the surface of the soap from gradually dissolving into the covering.

It is a yet further object of the invention to provide an improved washing aid which can be used as an abrasive and can carry water in the form of a sponge.

According to the invention therefore, there is provided a washing aid comprising a washing body which is encased in a stretched fabric formed from spandex yarn.

It is a further object of the invention to provide an improved method of manufacturing a covered soap tablet which enables covered soap to be manufactured at an economic price by a simple inexpensive manufacturing technique.

Accordingly, the invention provides a method of manufacturing a soap tablet covered by a stretched fabric formed from spandex yarn, the method comprising forming a tube of the fabric having a periphery less than the intended periphery of the tablet, stretching the tube, inserting the tablet in the stretched tube and closing the tube on both sides of the tablet.

The washing aid can comprise a soap tablet and the covered soap tablet has a number of important advantages relative to prior arrangements. Firstly, it can be manufactured inexpensively. Secondly, it reduces the tendency of a soap tablet to slip from the grasp of the user because the frictional characteristics of the covering are much greater than those of the moist soap. Furthermore, the covering provides an abrasive action in view of the raised yarns within the fabric. To provide a particularly advantageous abrasive effect, the fabric is preferably formed from a raschel knit.

The moisture take-up of the fabric is very small and therefore the outer surface of the soap is kept drier than conventional uncovered soap or the soap covered by sponge or other moisture retaining fabric which can cause the soap to become very sticky and to lose its solidity at the surface.

In accordance with a second aspect of the invention, the covering can be applied to a conventional sponge. Such a sponge can be used either as a hand sponge for personal use or as a cleaning sponge for floors or other household objects. In both cases, but particularly in relation to the household sponge, the dirt and other foreign matter attaches to the outside covering and hence can be rinsed very easily from the outside covering. Conventional sponges tend to draw the dirt and other matter into the body of the sponge and hence very rapidly become discolored and unpleasant. The improved sponge according to the invention acts by the water for the washing operation being carried by the interior sponge material while the outer covering acts as the abrasive and dirt collecting layer.

In both cases, the covering is applied under tension so that its natural resilience tends to draw it back over the body of the washing aid when it shrinks and to retain the covering in contact with the washing aid. Thus, as the soap shrinks down, the covering follows the size of the soap and remains taut over the body of the soap down to a minimum size. Below that size, the covering allows very small pieces of soap to be grasped and effectively used.

With the foregoing in view, and other advantages as will become apparent to those skilled in the art to which this invention relates as this specification proceeds, the invention is herein described by reference to the accompanying drawings forming a part hereof, which includes a description of the best mode known to the applicants and of the preferred typical embodiment of the principles of the present invention, in which:

DESCRIPTION OF THE DRAWINGS

In the drawings like characters of reference indicate corresponding parts in the different figures.

DETAILED DESCRIPTION

The fabric used in the manufacture of the products using either the soap tablet or the sponge is a raschel knit fabric formed from a covered spandex yarn which may be of the type manufactured by Dupont under the trademark LYCRA. Spandex yarns have been known for many years and basically provide an elastomeric yarn which is therefore of very high stretch.

Preferably, the yarns used are covered elastomeric yarns where a sheath of outer fibres is wrapped around the basic elastomeric core.

The yarns have been used in various types of fabrics mainly for apparel where high stretch is required.

The fabric from the yarn is preferably a raschel knit which provides a rapid fabric formation technique and hence relatively cheaply available fabric while having properties which are particularly suitable for the use proposed, that is firstly the fabric has a rough side and a smooth side formed by the knitting process which enables the provision of a desired outer surface for the product which has the required level of abrasion depending upon the desired end use. In addition, the fabric has differential levels of stretch longitudinally and transversely of the fabric and these different stretch characteristics can be used in the final product in dependence upon the mode of operation of the final product.

In addition, the fabrics formed from the spandex yarns have very low moisture retention and effectively only moisture is held in the interstices between the yarns and fibres rather than in the fibres themselves.

The initial step in manufacturing a covered washing aid in either the sponge or soap form is to manufacture a tube of the spandex fabric. Such a tube having a diameter or transverse dimension selected in accordance with the eventual required dimension after stretch to the desired degree is manufactured by one of a number of possible techniques. Firstly, the tube can be formed by knitting the fabric in the required tubular form by a circular knitting technique. Secondly, the tube can be formed by sewing along a seam using an elastomeric yarn having similar stretch characteristics to the spandex fabric. Thirdly, the tube can be formed by sewing along a seam while the fabric is stretched to the required degree of stretch that will be used in the final product. In this case, the sewing can be carried out using conventional yarn or sewing thread with little stretch in comparison with the elastomeric fabric.

When the fabric retracts back to its normal condition, the sewing thread merely buckles but retains the fabric in the required tubular form and is not broken by the extension of the fabric to the stretched condition.

Figure 3:
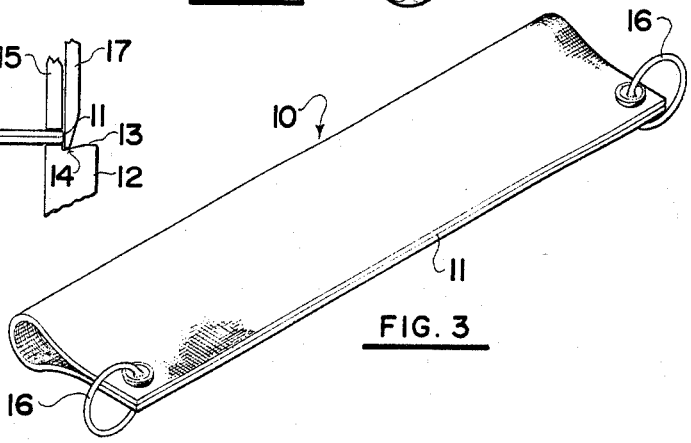
FIG. 3 is an isometric view showing a tube of the fabric during its formation.

In accordance with a further technique, the fabric tube can be formed by welding along a seam while the fabric is held in the stretched condition. The tube is illustrated in FIG. 3 merely as a simple folded strip of the fabric which can be of any convenient length. The strip is indicated at 10 with a seam along the overlapped edges of the folded strip indicated at 11. In order to complete the tube, the tube can be turned inside out so that the seam is inward of the tube and does not appear on the outside of the finished product. Heat sealing or welding of the tube has the advantage that the seam is very narrow since the ends of each portion of the yharn are grasped by the welding of heat sealing technique and held into the seam. The sewing technique requires a larger seam in view of the necessity to provide an edge which resists fraying adjacent the seam.

The tube is formed such that the seam lies longitudinally of the yarn in the fabric and of the direction of greater stretch. This allows this seam to lie along the longer axis of the finished product, either the soap or the sponge and particularly in the soap, the longer stretch lies around the larger dimension thus better accommodating shrinkage of the soap in use.

Figure 4:
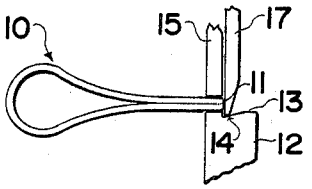
FIG. 4 is a cross sectional view of the tube of FIG. 3 showing the formation of a heat seal.

FIG. 4 shows the welding or heat sealing technique in which the tube 10 is folded so the edges overlie as indicated at 11 and are positioned above an elongate anvil 12 which has a flat upper surface 13 with a groove 14 along the length thereof. A vertically reciprocating clamping blade 15 can be positioned adjacent the edge 11 so as to clamp the edge between the blade 15 and the anvil 12. The positioning is arranged such that the edge 11 then just overlies the groove 14. A pair of C-clamps 16 shown in FIG. 3 initially stretches the fabric along its length and holds the fabric in the overlying edge condition for movement of the blade into the clamping position relative to the anvil 12. A heated heat sealing tool 17 is then applied at the groove 14 either in the form of a stylus which moves along the groove from one end to the other end or in the form of a blade parallel to the blade 15 which comes down to the groove and acts to seal the edges in one step.

The stylus 17 is electrically heated to a temperature in the range 530° F. to 620° F. and preferably of the order of 600° F. At this temperature it is desirable to use an anvil 12 which has a low heat conductivity so the temperature applied to the edge 11 of the fabric is applied strictly by the stylus. It is also possible to use a heat conductive anvil formed of a suitable metal but in this case the temperature of the stylus can be reduced. In addition, the type of seal and the width of the seal is dependent upon the material of the anvil and the heat of the stylus.

In one arrangement, the stylus can be used to not only seal the edge of the fabric but also to cut that edge from the next adjacent portion of the fabric. In such a technique, two tubes can be formed simultaneously by heat sealing using the stylus and at the same time cutting with the stylus centrally of the heat seal. In this arrangement, a second clamping blade 15 is positioned on the opposite side of the stylus 17 to hold the heat seal of the next adjacent tube in contact with the anvil 12.

Figure 5:
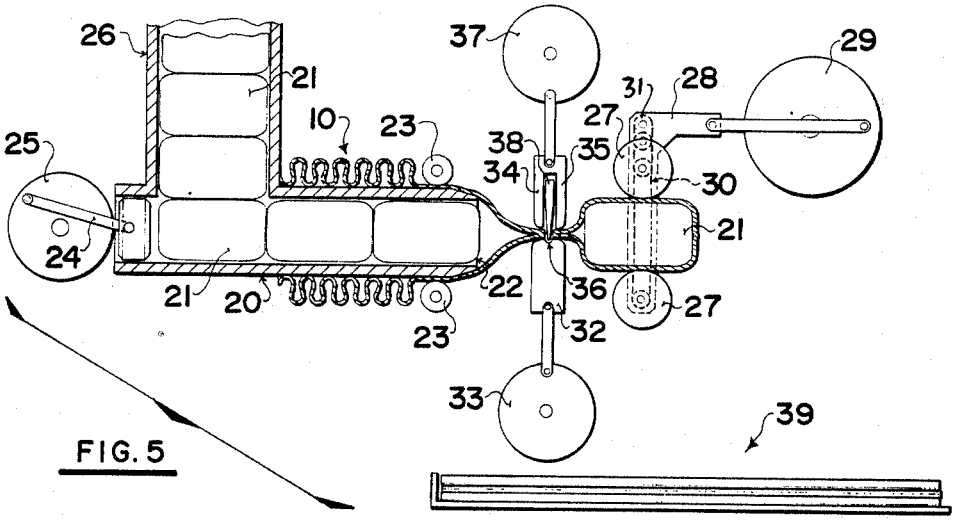
FIG. 5 is a schematic cross sectional view of a machine for inserting soap tablets into the tube of FIG. 3 and closing the tube around the individual tablet.

Turning now to FIG. 5, there is shown schematically a machine for injecting the soap or sponge into the tube 10. The device comprises an injector tube 20 through which the soap tablets 21 can pass for ejection through a mouth 22 of the tube 20.

The injector tube 20 provides an elongate nozzle on the outer surface of which is positioned the tube 10 after inversion to place the seam on the inner surface adjacent the injector tube 20. The dimensions of the tube 10 are such as to provide the requisite degree of stretch in the finished product and thus the tube 10 is stretched over the tube 20 to a slightly greater degree than the finished product in view of the thickness of the tube 20 which thus increases the dimension of the soap tablets 21. The soap tablets 21 are closely confined within the tube 20 so that the stretch of the tube 10 on the outer surface of the tube 20 which is at or near the maximum acceptable stretch achieves a stretch in the finished product which is again very close to the maximum acceptable stretch in the fabric.

A pair of rollers 23 is positioned adjacent or in contact with the outer surface for controlling the forward movement of the tube 10 off the end of the injector tube 20. Thus, on the left-hand side of the rollers 23 the tube 10 is under no longitudinal tension and forms concertina folds as a reservoir of the tube to be fed forwardly by the roller 23. On the right-hand side of the rollers 23 the fabric of the tube 10 is under longitudinal and transverse tension.

The injector tube 20 includes a reciprocating ram 24 operated, for example, by an eccentric 25 which operates to forward the soap tablets 21, one at a time, past a magazine 26 from which a reservoir supply of the soap tablets can be obtained.

Downstream of the mouth 22 of the injector tube 20 is positioned a pair of rollers 27 which are mounted for rotation and for reciprocating movement of their axis of rotation towards and away from the mouth 22. For this purpose, the rollers 27 are mounted on a frame 28 operable by an eccentric 29. The rollers can be rotated by a drive belt 30 under control of a pulley 31. In view of the schematic nature of the diagram, the drives to the eccentrics and to the pulley 31 are omitted, but will be apparent to one skilled in the art.

The rollers 27 can thus be reciprocated by the eccentric 29 to a position immediately adjacent the mouth 22 at which they can grasp a soap tablet ejected from the mouth together with the surrounding fabric from the tube 10 and pull it away from the mouth by the return reciprocal movement. The fabric is thus stretched between the rollers 23 and the rollers 27 in longitudinal direction.

After movement of the rollers 27, an anvil 32 operated by an eccentric 33 is moved upwardly into the position between the mouth 22 and the rollers 27 to engage the fabric on the underside thereof. The anvil 32 is similar in construction to the anvil 12 and cooperates with a pair of blades 34, 35 which form a nip with the upper surface of the anvil on either side of a groove 36 provided transversely to the length of the tube 10. The blades 34, 35 are moved by an eccentric 37 so they can be raised and lowered into position and when raised, removed out of the way of the rollers 27 to enable grasping of the soap tablet 21.

A blade or scribe 38 positioned between the blades 34, 35 which is electrically heated to a suitable temperature as previously described engages the fabric at the groove 36 to form a heat seal and at the same time sever the fabric between two heat seals formed between the blade and the adjacent blades 34, 35. Thus, when the heat sealing blade 38 has completed its task it can be removed from the fabric and then the fabric released so that under its stretch condition, it falls back to the soap 21 on one side and to the mouth 22 on the other side. At this time, both the anvil 32 and the blades 34, 35 can be removed from their sealing position to allow the ram 24 to forward a further soap out of the mouth to engage the sealed end of the tube and push the soap into the sealed end to stretch the sealed end relative to the rollers 23. As explained previously, the rollers 27 then grasp the soap and then draw it away from the mouth 22 while the rollers 23 forward a length of the tube sufficient to wrap the tablet 21.

The process is then repeated and in each case the wrapped soap tablet is then forwarded by the rollers 27 and dropped onto a conveyor 39 positioned beneath the rollers 27 for subsequent packaging.

Figure 1:
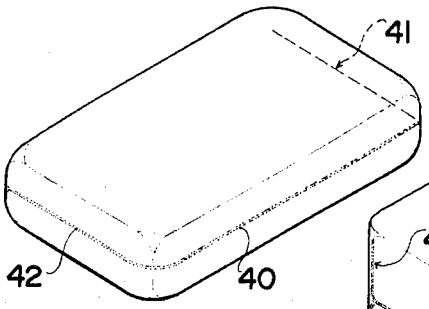
FIG. 1 is an isometric view of a soap tablet covered by a fabric layer.

A completed soap is shown in FIG. 1 and it will be noted that the tube seam indicated at 40 lies along the side of the soap tablet and the transverse seams 41 and 42 are the seams formed by the blade 38.

The fabric is stretched over the soap to at least 50% and preferably 60% of its complete stretch. In this way as the soap is worn away in use, the fabric shrinks back with the soap to substantially remain taut over the soap for the majority of the use of the soap. The final portion of the soap can be used with the fabric no longer stretched, but remaining in contact with the soap by virtue of the effect by which the fabric becomes slightly embedded in the surface of the soap by the repeated wetting and drying of the soap.

It will be noted that the seams lie along the edges of the soap and thus do not interfere with the faces of the soap being used as an abrasive. It will also be noted that the seams lie flat to the soap and thus the tablet of soap retains its customary shape and does not have any protruding pieces of fabric which act merely to soak up water and dissolved soap in an unacceptable manner.

The fabric and the way in which it is applied to the soap tablet has a number of advantages. Firstly, it reduces the amount of lather which is obtained from the soap while in no way interfering with the emulsion effect which is required from the soap for washing. Next, the fabric provides an abrasive action while being prevented from slipping on the soap both by the tension and by the fact that the tension causes the fabric to slightly enter the surface of the soap so that some of the soap protrudes into the interstices between the fibres or yarns. The soap is firm in the hand of the user and hence has the generally acceptable and pleasing appearance of a conventional soap tablet. No squeezing or twisting of the soap and fabric is necessary to obtain the emulsion or to remove the soap from the fabric. It is only necessary to rinse the fabric and soap tablet to remove any undesirable residues.

Figure 2:
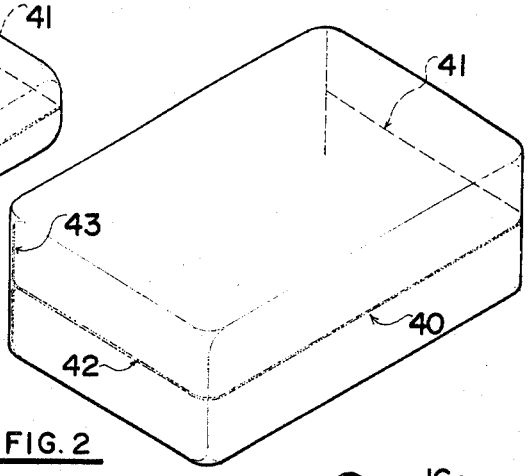
FIG. 2 is an isometric view of a household sponge covered by the fabric layer.

The sponge, as illustrated in FIG. 2, can also be manufactured by the technique as illustrated in FIGS. 3, 4 and 5 but in this case in view of the increased dimension of a conventional hand sponge, additional seams are necessary in some cases to avoid excess fabric which is unstretched. Thus, there is a longitudinal tube seam 40 as in the soap and transverse seams 41 and 42 at the end of the sponge, but in addition there are vertical seams 43 leading from the transverse seam to the corners of the soap to form effectively a rectangular covering for the sponge. In the case of the sponge, the tension of the fabric is arranged such that it is stretched to 50% of the maximum stretch in the relaxed condition of the sponge. This stretch retains the sponge in an integral condition and prevents the fabric moving around the outer surface of the sponge.

The fabric can also be used particularly in relation to the soap to receive printed names or other information which can be distinguished by colour thus improving the attractiveness of the product in a way which cannot be achieved in a conventional soap tablet.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A washing aid comprising a substantially solid, integral tablet of soap encased in a fabric forming a single layer fully surrounding the soap tablet, said fabric being formed from a spandex yarn and comprising a thin substantially incompressible layer of very low moisture absorption characteristic and being stretched such that each portion thereof is tensioned into contact with the soap tablet.

2. The invention according to claim 1 wherein the fabric is stretched to substantially its fullest extent.

3. The invention according to claim 1 wherein the fabric is stretched to greater than 50% of its stretch.

4. The invention according to claim 1 wherein the fabric is knitted from spandex yarn.

5. The invention according to claim 3 wherein the fabric is a raschel knit.

6. The invention according to claim 1 wherein the fabric includes at least one seam lying along the tablet so the fabric lies flat against the surface of the tablet.

7. The invention according to claim 6 wherein the seams are formed by heat sealing.

8. The invention according to claim 7 wherein the heat sealed seam lies along the direction of formation of the fabric.

9. The invention according to claim 6 wherein the fabric is formed in a tube and wherein the seams extend across the tube to fully encase the tablet.

10. The invention according to claim 1 wherein the fabric is formed with a differential stretch between the direction parallel to the direction of formation and the direction at right angles thereto and wherein the fabric is wrapped around the soap such that the direction of longer stretch extends around the shorter peripheral extent of the tablet.

11. The invention according to claim 1 wherein the yarn is formed from covered spandex fibres.

* * * * *